US011109652B2

(12) United States Patent
Berka et al.

(10) Patent No.: US 11,109,652 B2
(45) Date of Patent: Sep. 7, 2021

(54) JEWELRY SYSTEM

(71) Applicant: TALIA LUXURY GOODS LTD., Herzliya (IL)

(72) Inventors: Ronen Berka, Ramat Hasharon (IL); Tal Man, Ramat Hasharon (IL)

(73) Assignee: TALIA LUXURY GOODS LTD., Herzliya (IL)

( * ) Notice: Subject to any disclaimer, the term of this patent is extended or adjusted under 35 U.S.C. 154(b) by 0 days.

(21) Appl. No.: 16/767,294

(22) PCT Filed: Nov. 7, 2018

(86) PCT No.: PCT/IL2018/051196

§ 371 (c)(1),
(2) Date: May 27, 2020

(87) PCT Pub. No.: WO2019/106653

PCT Pub. Date: Jun. 6, 2019

(65) Prior Publication Data

US 2021/0022459 A1 Jan. 28, 2021

Related U.S. Application Data

(60) Provisional application No. 62/591,996, filed on Nov. 29, 2017.

(51) Int. Cl.
*A44C 25/00* (2006.01)
*A44C 17/02* (2006.01)
(Continued)

(52) U.S. Cl.
CPC ..... *A44C 17/0258* (2013.01); *A44C 7/002* (2013.01); *A44C 11/00* (2013.01);
(Continued)

(58) Field of Classification Search
CPC ..... A44C 17/0258; A44C 7/002; A44C 11/00; A44C 13/00; A44C 25/001; A44C 25/002;
(Continued)

(56) References Cited

U.S. PATENT DOCUMENTS 915,678 A * 3/1909 Kantor et al. ..... A44C 17/0275 63/31
1,899,165 A * 2/1933 Rivet ..... A44C 25/002 63/1.15
(Continued)

FOREIGN PATENT DOCUMENTS

DE 29604934 U1 5/1996
EP 3016538 A1 5/2016
FR 3027523 A1 * 4/2016 ..... A44C 25/002

OTHER PUBLICATIONS

International Search Report, International Application No. PCT/IL2018/051196, dated Feb. 20, 2019.
(Continued)

*Primary Examiner* — Jack W Lavinder
(74) *Attorney, Agent, or Firm* — The Roy Gross Law Firm, LLC; Roy Gross

(57) ABSTRACT

There is provided herein a jewelry system comprising a first segment having a shape of a ring, the first segment comprising two coaxially positioned apertures being essentially parallel to the ring's plane; a second segment sized and shaped to fit within the ring of the first segment, wherein the second segment comprises an aperture extending therethrough; and a rod configured to extend through the apertures of the first and second segments, thereby securing the second segment within the ring of the first segment.

20 Claims, 4 Drawing Sheets

(51) Int. Cl.

| | |
|---|---|
| ***A44C 7/00*** | (2006.01) |
| ***A44C 11/00*** | (2006.01) |
| ***A44C 13/00*** | (2006.01) |
| ***A44C 27/00*** | (2006.01) |

(52) U.S. Cl.
CPC ..... *A44C 13/00* (2013.01); *A44C 25/001* (2013.01); *A44C 27/00* (2013.01)

(58) Field of Classification Search
CPC ..... A44C 25/004; A44C 25/007; A44C 27/00; A44C 15/005
USPC ..... D11/79; 63/13, 23
See application file for complete search history.

(56) References Cited

U.S. PATENT DOCUMENTS

| | | | | |
|---|---|---|---|---|
| 3,596,380 | A * | 8/1971 | Williams | A63F 9/001 434/402 |
| 4,353,225 | A | 10/1982 | Rogers | |
| 4,430,869 | A * | 2/1984 | Zinni | A44C 25/001 40/618 |
| 4,879,882 | A | 11/1989 | Johnson et al. | |
| 4,970,878 | A * | 11/1990 | Lee | A44C 17/0266 63/23 |
| 4,977,757 | A * | 12/1990 | Mesica | A44C 9/00 63/15 |
| 5,836,176 | A | 11/1998 | Lichtenstein et al. | |
| 6,381,985 | B1 | 5/2002 | Burgard | |
| 8,245,533 | B2 * | 8/2012 | Avneri-Katzir | A44C 13/00 63/15 |
| 8,496,483 | B1 | 7/2013 | Walters | |
| 9,421,452 | B2 * | 8/2016 | Carlow | A63F 11/0011 |
| 2002/0116947 | A1 | 8/2002 | Mount | |
| 2005/0178155 | A1 | 8/2005 | Poli | |
| 2008/0016915 | A1 * | 1/2008 | Shah | A44C 25/001 63/40 |
| 2009/0038338 | A1 | 2/2009 | Korwin | |
| 2013/0239610 | A1 | 9/2013 | Lim | |
| 2016/0106186 | A1 | 4/2016 | Noble | |

OTHER PUBLICATIONS

Written Opinion of the International Searching Authority, International Application No. PCT/IL2018/051196, dated Feb. 20, 2019.
Supplementary European Search Report for Application No. EP18883464, completed Dec. 21, 2020, 1pg.

* cited by examiner

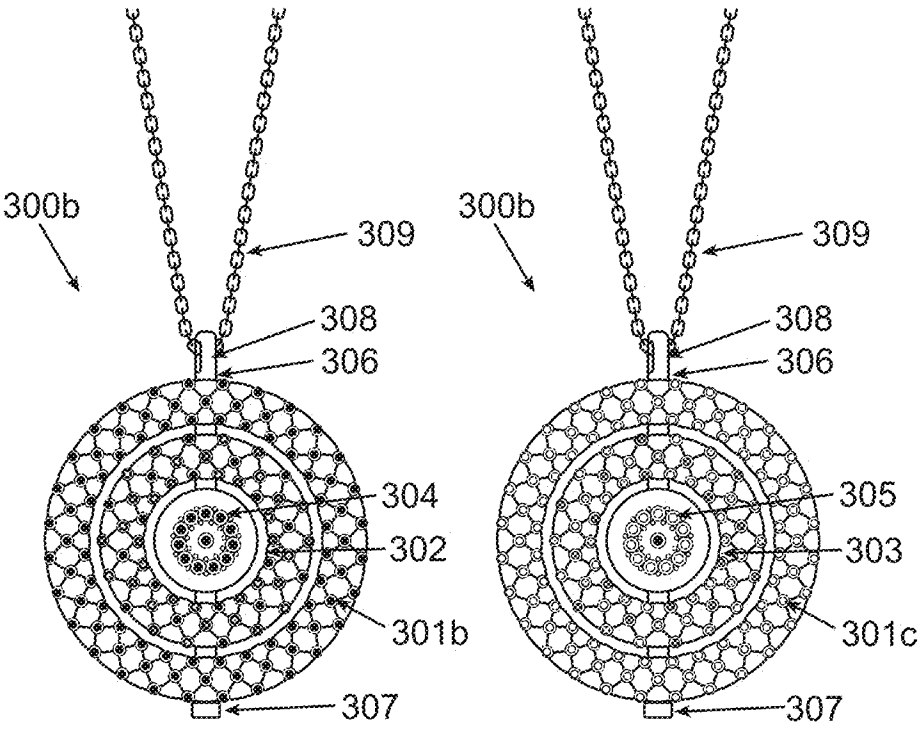
FIG. 3C
FIG. 3B
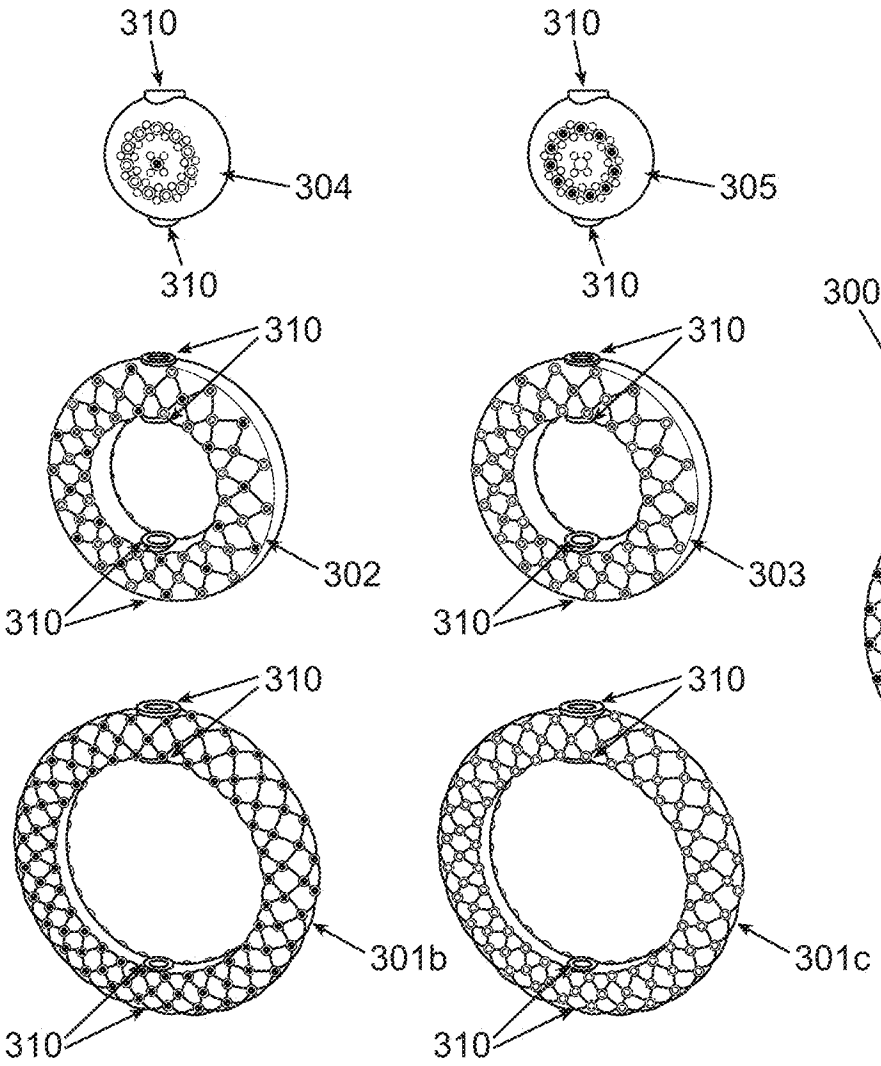
FIG. 3A

JEWELRY SYSTEM

CROSS REFERENCE TO RELATED APPLICATIONS

This application is a National Phase of PCT Patent Application No. PCT/IL2018/051196 having International filing date of Nov. 7, 2018, which claims the benefit of priority of U.S. Provisional Application No. 62/591,996 filed on Nov. 29, 2017 entitled JEWELRY SYSTEM. The contents of the above applications are all incorporated by reference as if fully set forth herein in their entirety.

FIELD OF THE INVENTION

Embodiments of the disclosure relate to jewelry.

BACKGROUND

The art of jewelry and body ornamentation is replete with numerous variations in the design of various decorative elements such as, for example, bracelets, necklaces, pendants, watches and the like, each providing the users with a unique opportunity to adorn themselves with a variety of decorative embellishments as their particular mode may dictate. With the wide variety of such individual decorative elements available to the potential user, one is often faced with the situation of having an enormous collection of decorative elements, each of which exists only as a stand alone item, which, while appropriate to be worn in the context for which it was originally, designed does not allow the user to readily adapt that item to other uses.

SUMMARY

The following embodiments and aspects thereof are described and illustrated in conjunction with systems, tools and methods which are meant to be exemplary and illustrative, not limiting in scope.

The present invention is directed to jewelry, and more particularly to a pendant design that employs a plurality of segments and which has features that allow the segments to be interchanged, replaced, removed and/or combined in various ways. Advantageously, the ability to interchange, replace, or remove the segments of the pendant and combine it in various ways provides a user with the ability of adopting variety of different looks by using the pendant.

Some embodiments of the present invention are directed to a pendant. When assembled, the pendant features interchangeable decorative elements or segments which are arranged one within the other and threaded, via one or more apertures in each of the segments, onto a central rod. Optionally, the pendant may be suspended from a chain or cord of a necklace, bracelet, earring, or similar articles of jewelry, by threading the chain or cord through an integrally-formed aperture or eyelet at the top end of the central rod.

A plurality of desired number of segments may be employed, according to the feature set desired by the wearer of the pendant.

Advantageously, according to some embodiments, removing the pendant from the chain and replacing the decorative segments is a simple and straightforward task which does not demand a good level of dexterity.

Advantageously, according to some embodiments, the decorative elements may be securely fastened on a central rod as opposed to threading beads and the like on a necklace which can be tricky due to the flimsiness of necklace material (whether a chain, string or the like).

According to some embodiments, there is provided a jewelry system comprising a first segment having a shape of a ring, the first segment comprising two coaxially positioned apertures being essentially parallel to the ring's plane; a second segment sized and shaped to fit within the ring of the first segment, wherein the second segment comprises an aperture extending therethrough; and a rod configured to extend through the apertures of the first and second segments, thereby securing the second segment within the ring of the first segment.

According to some embodiments, the rod has a stopper at a first end thereof for limiting movement of the first and second segments along the rod and a completely closed eyelet integrally formed in a second end of the rod, the eyelet adapted to receive there-through a threadable, frictionally engageable member, which, when threaded through the eyelet, secures the plurality of segments on the rod.

According to some embodiments, when the first and second segments are threaded on the rod they are allowed to spin/rotate around the rod independently of one another.

According to some embodiments, the first segments has a shape of an essentially flat ring.

According to some embodiments, the second segment has a shape of a flat plate.

According to some embodiments, the first segment has a shape of a circular ring. According to some embodiments, the first segment has a shape of a rectangular ring. According to some embodiments, the first segment has a shape of a triangular ring.

According to some embodiments, the third segment has a shape of an essentially flat ring, wherein the third segment is sized and shaped to fit within the ring of the first segment, and wherein the second segment is sized and shaped to fit within the ring of the third segment. According to some embodiments, the third segment comprises two coaxially positioned apertures being essentially parallel to the ring's plane.

According to some embodiments, when the first, second and third segments are threaded on the rod, the third segments is allowed to spin/rotate around the rod independently of the first and the second segments.

According to some embodiments, coaligned surfaces of the first, second and/or third segments form a mandala. According to some embodiments, rotation of the first, second and/or third segment relative to one another changes the shape of the mandala. As used herein, the term "mandala" may refer to concentric configurations of geometric shapes.

More details and features of the current invention and its embodiments may be found in the description and the attached drawings.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. It is intended that the embodiments and figures disclosed herein are to be considered illustrative rather than restrictive. The figures are listed below:

FIG. 3A schematically depicts decorative segments adopted to be assembled to a jewelry system, according to an exemplary embodiment of the current invention;

FIGS. 3B and 3C schematically depict different configurations of a jewelry system assembled from segments of FIG. 3A, according to an exemplary embodiment of the current invention;

DETAILED DESCRIPTION

Figure 1C:
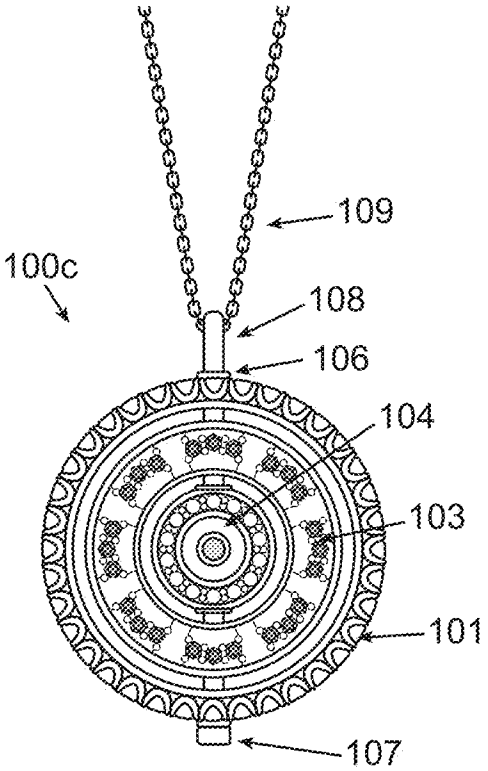
FIGS. 1B and 1C schematically depict different configurations of a jewelry system assembled from segments of FIG. 1A, according to an exemplary embodiment of the current invention.

Disclosed herein is a jewelry system. The jewelry system comprises, a plurality of segments, each of the segments comprising at least one aperture that extends through each of the segments, the apertures positioned in each of the segments to allow for the apertures in each of the segments to align at least substantially coaxially when the plurality of segments are arranged one within the other on the same plane; and a rod for receiving the segments and extending through the apertures of the segments, the rod including a first end including a stopper for limiting movement of the segments along the rod.

As used herein, the term "plurality", when referring to segments, may include two, three, four, five or more segments. Each possibility is a separate embodiment. According to some embodiments, the segments are so formed that the outer circumference of one segment is delimited by the inner circumference of another segment such that the one segment can be positioned within the second segment, while allowing the segments to rotate/spin essentially freely and independently of each other. According to some embodiments, the segments are concentric when positioned one within the other.

Optionally, one or more of the segments are flat ring-shaped segments of varying shapes. In such embodiments, the segments include two apertures which are substantially coaxially aligned. Optionally, the segments are arranged one within the other. Optionally, at least some of the segments may be shaped as a ring/hoop. As used herein the terms "hollow segments", "ring-shaped segments" "disc shaped segments" may be used interchangeably and encompass segments having a variety of circumferential shapes, such as, but not limited to, circular, triangular, rhombus, trapezoid, rectangular, and square circumferential shapes, with a hollow center. According to some embodiments the ring-shaped segments may be essentially flat.

Optionally, the jewelry system is arranged such that the apertures of each of the segments are co-axially aligned, and the rod is oriented for receiving each of the segments in a coaxial alignment.

Optionally, the jewelry system is such that the rod and the stopper are integrally formed as a single unit. Optionally, the jewelry system is such that the rod further comprises an eyelet at a second end of the rod opposite to the first end of the rod. Optionally, the jewelry system additionally comprises a cord which is received through the eyelet of the rod.

The central rod may be, for example, a single piece with an integrally formed stopper on the one end and an eyelet on the other. Optionally, there aren't any moving parts and the rod itself does not need to be assembled or disassembled. The central rod may be, for example, straight and solid to allow the segments to be easily loaded and securely attached.

Optionally, the jewelry system is such that at least some of the segments are interchangeable with each other. Optionally, the jewelry system is such that the segments include decorative segments. Optionally, the jewelry system is such that each of the plurality of segments is allowed to independently spin/rotate upon a central axis of the rod.

Figure 1B:
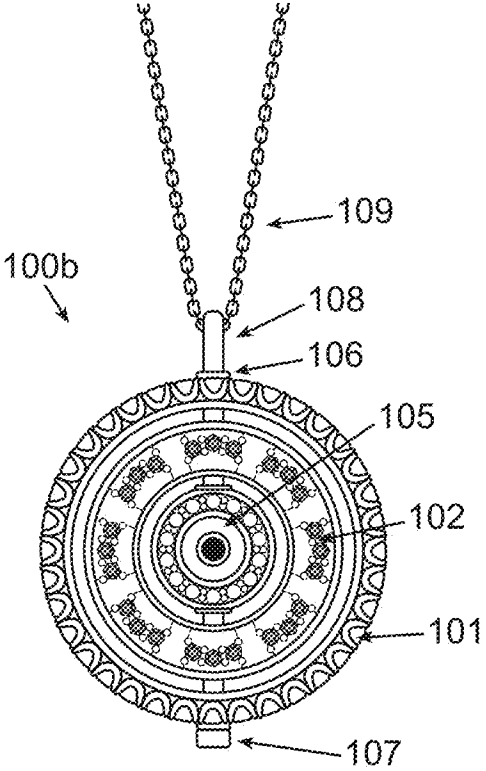
Figure 1A:
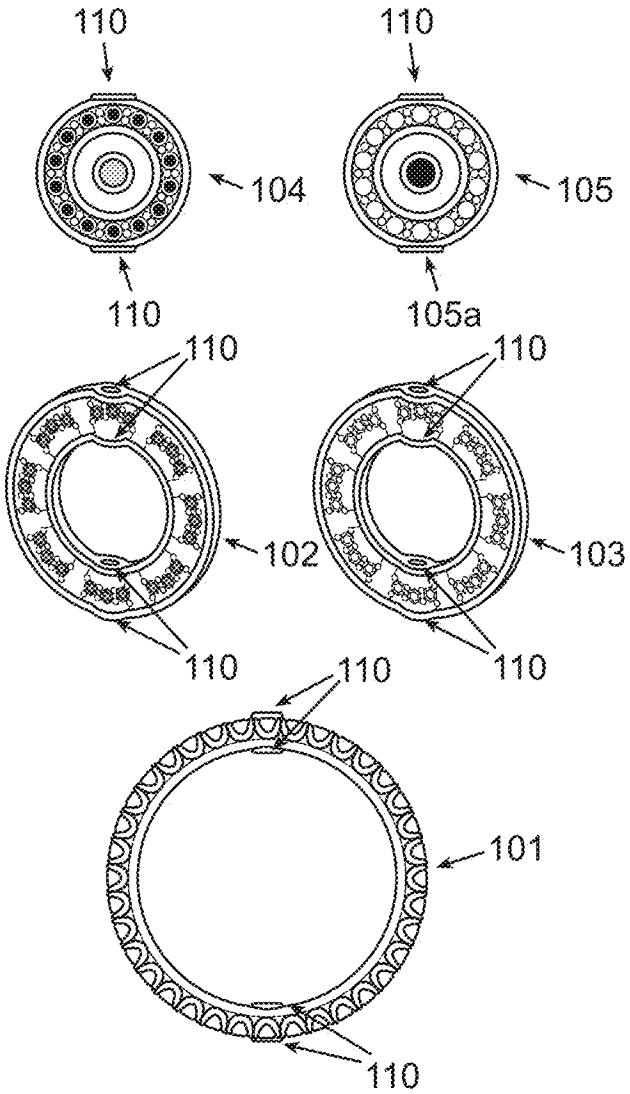
FIG. 1A schematically depicts decorative segments adopted to be assembled to a jewelry system, according to an exemplary embodiment of the current invention.

Reference is now made to FIGS. 1A, 1B and 1C, showing a plurality of decorative segments ('segments') in an assembled form (1A) and two alternative assemblies of the decorative segments into alternative pendant designs 100*b* (FIG. 1B) and 100*c* (FIG. 1C), according to some embodiments.

Referring to FIG. 1A, an outer segment 101 is shaped as a hollow ring/hoop and includes two apertures 110 co-aligned with a diameter thereof. Segment 101 is configured to house within a smaller segment. Middle segments 102 and 103 are shaped such as to be interchangeably housed within segment 101. Each of middle segments 102 and 103 includes two apertures 110 co-aligned with a diameter thereof, such as to allow apertures 110 of segments 102 or 103 to align at least substantially coaxially with apertures 110 of outer segment 101 when housed there within. Optionally, middle segments 102 and 103 are shaped as a hollow ring and configured to house a smaller segment therewithin. Inner segments 104 and 105 are shaped such as to be interchangeably housed within outer segment 101 and/or middle segment 102 or middle segment 103. Optionally, each of inner segments 104 and 105 is shaped as a substantially solid piece (e.g., bead) and includes an aperture 110 extending therethrough, such as to allow apertures 110 of inner segments 104 or 105 to align at least substantially coaxially with apertures 110 of outer segment 101 and middle segments 102 and 103 when housed there within. Alternatively, each of middle segments 104 and 105 may be hollow (e.g., a ring) and include two apertures 110 co-aligned with a diameter thereof (not shown).

Referring to FIG. 1B, pendant 100*b* includes decorative segments 101, 102 and 105 arranged one within the other (i.e., segment 105 is housed within segment 102 which is housed within segment 101) such that their apertures 110 are co-axially aligned. Segments 101, 102 and 105 are threaded onto a central rod 106 via their co-axially aligned apertures 110. Each of segments 101, 102 and 105 may independently be rotated/spin upon central rod 106.

Referring to FIG. 1C, decorative segments 101, 103 and 104 are arranged one within the other such that their apertures 110 are co-axially aligned. Segments 101, 103 and 104 are threaded onto a central rod 106 via their co-axially aligned apertures 110. Each of segments 101, 103 and 104 may independently be rotated/spin upon central rod 106.

With further referral to FIGS. 1B and 1C, central rod 106 may include a stopper 107 at a lower proximal end and an eyelet 108 at an upper proximal end. The main body of rod 106 may have a diameter smaller than the diameter of apertures 110 of each of the decorative segments so that rod 106 may receive thereon each of decorative segments 101, 102 and 105 (FIG. 1B) or segments 101, 103 and 104 (FIG. 1C) or any other combination thereof, while stopper 107 may have a diameter larger than that of apertures 110, which prevents, for example, decorative segments 101, 102 and 105 (FIG. 1B) or segments 101, 103 and 104 (FIG. 1C) from sliding off the lower end of rod 106. Eyelet 108 may have a diameter large enough to receive an ordinary necklace or chain such as chain 109 which, when threaded through eyelet 108 serves a dual purpose, namely: enabling pendant 100*b* or 100*c* to be worn by a user, and preventing decorative segments 101, 102 and 105 (FIG. 1B) or segments 101, 103 and 104 (FIG. 1C) from slipping off the top end of rod 106.

Figure 2C:
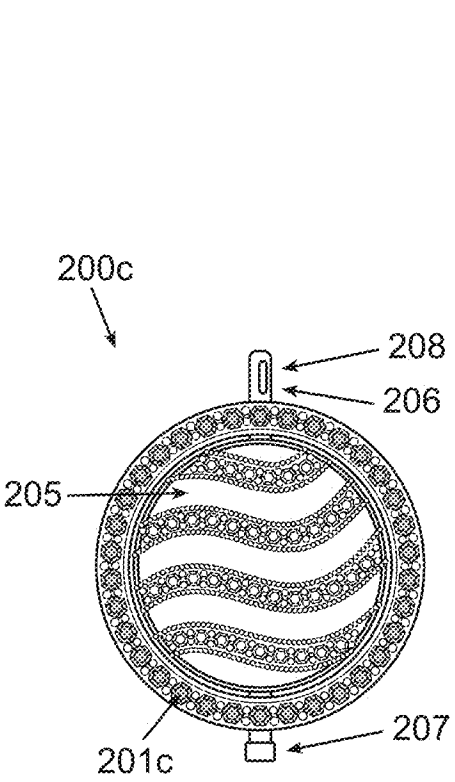
FIGS. 2B and 2C schematically depict different configurations of a jewelry system assembled from segments of FIG. 2A, according to an exemplary embodiment of the current invention.
Figure 2B:
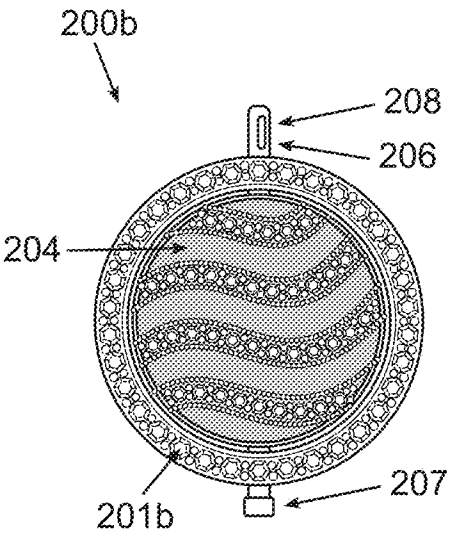
Figure 2A:
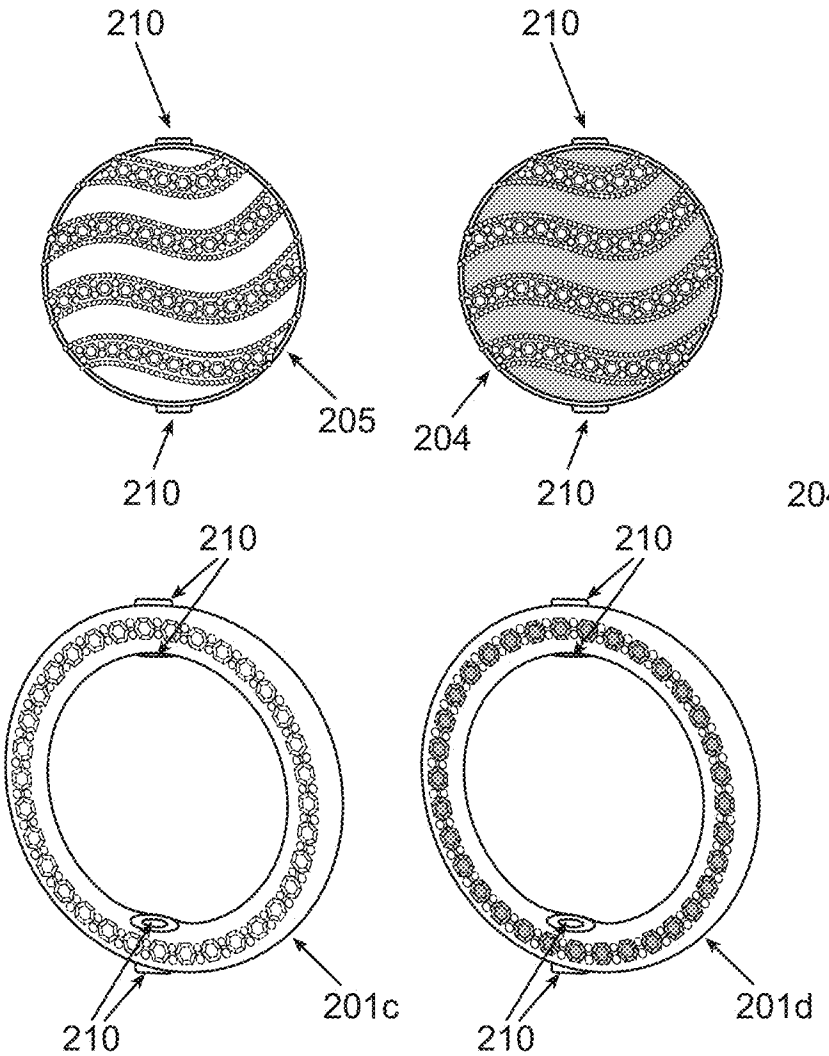
FIG. 2A schematically depicts decorative segments adopted to be assembled to a jewelry system, according to an exemplary embodiment of the current invention.

Reference is now made to FIGS. 2A, 2B and 2C, showing a plurality of decorative segments in an unassembled form (2A) and two alternative assemblies of the decorative segments into alternative pendant designs 200*b* (FIG. 2B) and 200*c* (FIG. 2C), according to some embodiments.

Referring to FIG. 2A, each of outer segments 201*b* and 201*c* is shaped as a hollow ring/hoop and includes two apertures 210 co-aligned with a diameter thereof. Optionally, outer segments 201*b* and 201*c* are shaped such as to be interchangeably used to house therewithin a smaller segment. Inner segments 204 and 205 are shaped such as to be interchangeably housed within outer segment 201*b* or 201*c*. Optionally, each of inner segments 204 and 205 is shaped as a substantially solid piece (e.g., bead) and includes an aperture 210 extending therethrough, such as to allow apertures 210 of segments 204 or 205 to align at least substantially coaxially with apertures 210 of outer segment 201.

Referring to FIG. 2B, pendant 200*b* includes decorative segments 201*b* and 204 arranged one within the other (i.e., segment 204 is housed within segment 201*b*) such that their apertures 210 are co-axially aligned. Segments 201*b* and 204 are threaded onto a central rod 206 via their co-axially aligned apertures 210. Each of segments 201*b* and 204 may independently be rotated/spun upon central rod 206.

Referring to FIG. 2C, pendant 200*c* includes decorative segments 201*c* and 205 arranged one within the other (i.e., segment 205 is housed within segment 201*c*) such that their apertures 210 are co-axially aligned. Segments 201*b* and 205 are threaded onto a central rod 206 via their co-axially aligned apertures 210. Each of segments 201*c* and 205 may independently be rotated/spun upon central rod 206.

With further referral to FIGS. 2B and 2C, central rod 206 may include a stopper 207 at a lower proximal end and an eyelet 208 at an upper proximal end. The main body of rod 206 may have a diameter smaller than the diameter of apertures 210 of each of the decorative segments so that rod 206 may receive thereon each of decorative segments 201*b* and 204 (FIG. 2B) or decorative segments 201*c* and 205 (FIG. 2C), or alternative combinations thereof (not shown), while stopper 207 may have a diameter larger than that of apertures 210, which prevents decorative segments 201*b* and 204 (FIG. 2B) or segments 201*c* and 205 (FIG. 2C), or alternative combinations thereof (not shown), from sliding off the lower end of rod 206. Eyelet 208 may have a diameter large enough to receive an ordinary necklace or chain (not shown) which, when threaded through eyelet 208 serves a dual purpose, namely: enabling pendant 200*b* or 200*c* to be worn by a user, and preventing decorative segments 201*b* and 204 (FIG. 2B) or segments 201*c* and 205 (FIG. 2C) from slipping off the top end of rod 206.

Central rod 206 may be, for example, a single piece with an integrally formed stopper 207 on the one end and an eyelet 208 on the other. Optionally, there aren't any moving parts and rod 206 itself does not need to be assembled or disassembled. Central rod 206, may be, for example, straight and solid to allow the segments to be easily loaded and securely attached.

Reference is now made to FIGS. 3A, 3B and 3C, showing a plurality of decorative segments ('segments') in an assembled form (3A) and two alternative assemblies of the decorative segments into alternative pendant designs 100*b* (FIG. 3B) and 100*c* (FIG. 3C), according to some embodiments.

Referring to FIG. 3A, each of outer segments 301*b* and 301*c* is shaped as a hollow ring/hoop and includes two apertures 310 co-aligned with a diameter thereof. Segments 301*b* and 301*c* are configured to interchangeably house therewithin a smaller segment or segments. Middle segments 302 and 303 are shaped such as to be interchangeably housed within segment 301*b* and 301*c*. Each of middle segments 302 and 303 includes two apertures 310 co-aligned with a diameter thereof, such as to allow apertures 310 of segments 302 or 303 to align at least substantially coaxially with apertures 310 of outer segment 301*b* and 301*c* when housed there within. Optionally, middle segments 302 and 303 are shaped as a hollow ring and configured to house a smaller segment therewithin. Inner segments 304 and 305 are shaped such as to be interchangeably housed within outer segment 301*b* and 301*c* and/or middle segment 302 or 303. Optionally, each of inner segments 304 and 305 is shaped as a substantially solid piece (e.g., bead) and includes an aperture 310 extending therethrough, such as to allow apertures 310 of segments 304 or 305 to align at least substantially coaxially with apertures 310 of outer segment 301 and middle segments 302 and 303 when housed there within. Alternatively, each of middle segments 304 and 305 may be hollow (e.g., a ring) and include two apertures 310 co-aligned with a diameter thereof (not shown).

Referring to FIG. 3B, pendant 300*b* includes decorative segments 301*b*, 302 and 304 arranged one within the other such that their apertures 310 are co-axially aligned. Segments 301*b*, 302 and 304 are threaded onto a central rod 306 via their co-axially aligned apertures 310. Each of segments 301*b*, 302 and 304 may independently be rotated/spin upon central rod 306.

Referring to FIG. 3C, decorative segments 301*c*, 303 and 305 are arranged one within the other such that their apertures 310 are co-axially aligned. Segments 301*c*, 303 and 305 are threaded onto a central rod 306 via their co-axially aligned apertures 310. Each of segments 301*c*, 303 and 305 may independently be rotated/spun upon central rod 306.

Reference in now made to FIGS. 3B and 3C, central rod 306 may include a stopper 307 at a lower proximal end and an eyelet 308 at an upper proximal end. The main body of rod 306 may have a diameter smaller than the diameter of apertures 310 of each of the decorative segments so that rod 306 may receive thereon each of decorative segments 301*b*, 302 and 304 (FIG. 3B) or segments 301*c*, 303 and 305 (FIG. 3C) or any other combination thereof, while stopper 307 may have a diameter larger than that of apertures 310, which prevents, for example, decorative segments 301*b*, 302 and 304 (FIG. 3B) or segments 301*c*, 303 and 305 (FIG. 3C)

from sliding off the lower end of rod 306. Eyelet 308 may have a diameter large enough to receive an ordinary necklace or chain such as chain 309 which, when threaded through eyelet 108 serves a dual purpose, namely: enabling pendant 300*b* or 300*c* to be worn by a user, and preventing decorative segments 301*b*, 302 and 304 (FIG. 3B) or segments 301*c*, 303 and 305 (FIG. 3C) from slipping off the top end of rod 306.

Figure 4:
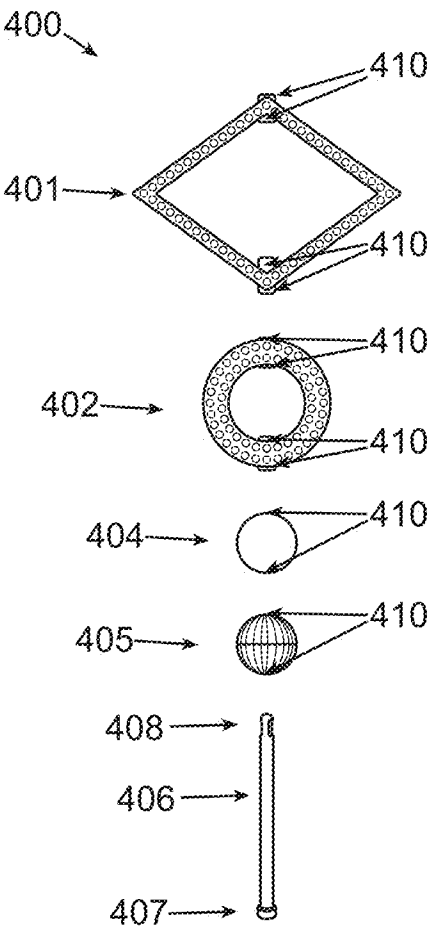
FIG. 4 is an exploded view of a jewelry system, according to an exemplary embodiment of the current invention.

Reference is now made to FIG. 4 which shows an exploded view of a jewelry system (e.g., pendant), according to an exemplary embodiment. Pendant 400 may include one or more of decorative segments 401, 402, 404, 405, each having apertures 410 designed to at least substantially co-axially align upon arrangement of the decorative segments, one within the other, such as to allow a central rod 406 to receive the decorative segments thereon via their co-axially aligned apertures 410. Optionally, outer segment 401 is shaped as hollow rhombus configured to house therewithin smaller segments such as middle segment 402. Inner segments 404 and 405, which are shaped as beads with apertures running therethrough, may be interchangeably housed within segment 401 and/or segment 402.

Figure 5:
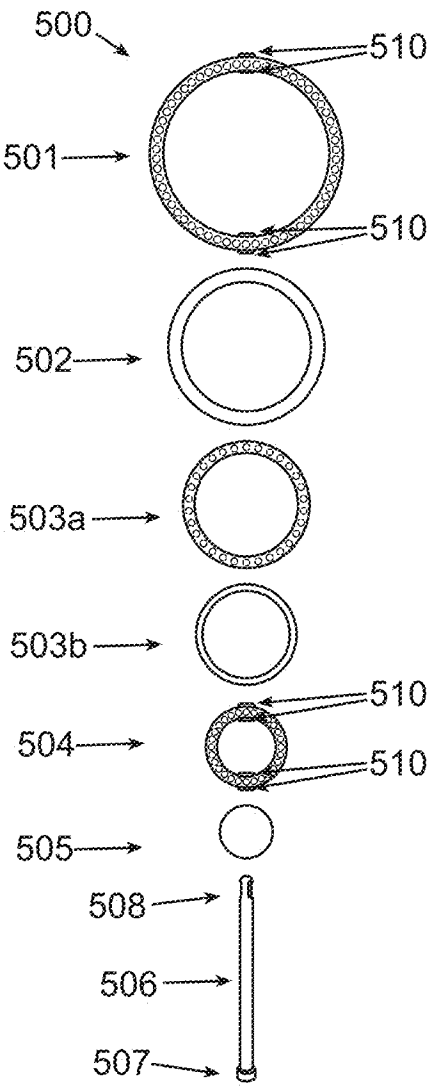
FIG. 5 is an exploded view of a jewelry system, according to an exemplary embodiment of the current invention.

Reference is now made to FIG. 5 which shows an exploded view of a jewelry system (e.g., pendant), according to an exemplary embodiment. Pendant 500 may include one or more of decorative segments 501, 502, 503*a*, 503*b*, 504, 505, each having apertures 510 (best shown in segments 501 and 504) designed to at least substantially co-axially align upon arrangement of the decorative segments one, within the other, such as to allow a central rod 506 to receive the decorative segments thereon via their co-axially aligned apertures 510. Optionally, outer segment 501 is shaped as a ring configured to house therewithin smaller segments such as segment 502, 503*a*, 503*b*, 504 and/or 505.

Figure 6:
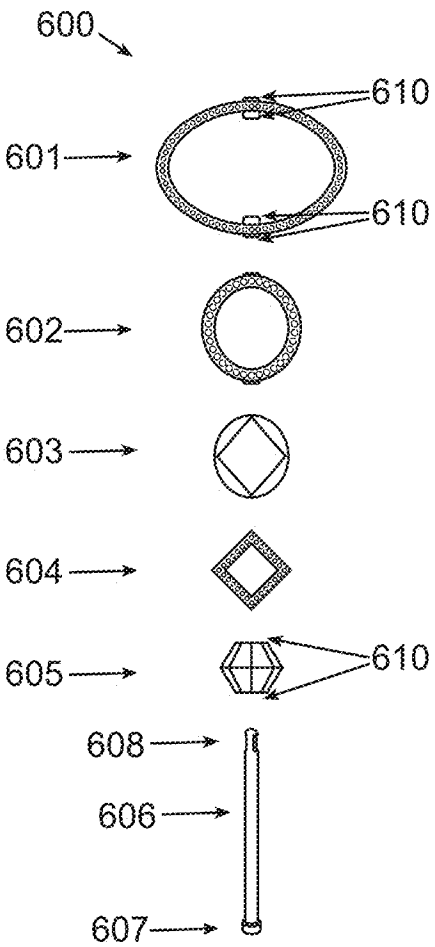
FIG. 6 is an exploded view of a jewelry system, according to an exemplary embodiment of the current invention.

Reference is now made to FIG. 6 which shows an exploded view of a jewelry system (e.g., pendant), according to an exemplary embodiment. Pendant 600 may include one or more of decorative segments 601, 602, 603, 604, 605, each having apertures 610 (best shown in segments 601 and 605) designed to at least substantially co-axially align upon arrangement of the decorative segments, one within the other, such as to allow a central rod 606 to receive the decorative segments thereon via their co-axially aligned apertures 610. Optionally, outer segment 601 is shaped as a hollow oval ring configured to house therewithin smaller segments such as middle segment 602, oval enamel 603, inner segments 604 and/or bead 605.

While a number of exemplary aspects and embodiments have been discussed above, those of skill in the art will recognize certain modifications, permutations, additions and sub-combinations thereof. It is therefore intended that the following appended claims and claims hereafter introduced be interpreted to include all such modifications, permutations, additions and sub-combinations as are within their true spirit and scope.

In the description and claims of the application, each of the words "comprise" "include" and "have", and forms thereof, are not necessarily limited to members in a list with which the words may be associated.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What we claim is:

1. A jewelry system comprising:

a) a first segment having a shape of an essentially flat ring, the first segment comprising two coaxially positioned apertures;

b) a second segment sized and shaped to fit within the ring of the first segment, wherein the second segment comprises an aperture extending therethrough; and c) a rod configured to extend through the apertures of the first and second segments, thereby securing the second segment within the ring of the first segment, the rod comprising:

a. a stopper having a larger outer diameter then the inner diameter of the apertures of the first and second segments, so as to prevent the first and second segments from slipping over the first end of the rod; and b. no more than one eyelet located at a second and opposite end of the rod;

wherein the outer diameter of the rod and the no more than one eyelet is less than the inner diameter of the apertures of the first and second segments such that the segments are slidable over the rod from the end thereof comprising the eyelet and such that the first and second segments can individually rotate around the rod.

2. The jewelry system of claim 1, wherein said second segment has a shape of a flat plate, rectangular ring or triangular ring.

3. The jewelry system of claim 1, further comprising a third segment having a shape of an essentially flat ring, wherein said third segment is sized and shaped to allow the first segment to be positioned within its ring, and wherein said third segment comprises two coaxially positioned apertures being essentially parallel to the ring's plane.

4. The jewelry system of claim 1, wherein when said first, second and third segments are threaded on the rod, the third segments is allowed to spin/rotate around the rod independently of said first and said second segment.

5. The jewelry system of claim 1, wherein coaligned surfaces of said first, second and/or third segments form a mandala.

6. The jewelry system of claim 1, wherein rotation of said first, second and/or third segment relative to one another changes the shape of the mandala.

7. The jewelry system of claim 1, wherein, the rod is configured to extend perpendicularly to the longitudinal axis of the threadable member, when the treadable member is threaded through the no more than one eyelet.

8. The jewelry system of claim 1, wherein when threaded through the no more than one eyelet both ends of the threadable member are located on a same side of the first and second segments.

9. The jewelry system of claim 1, further comprising the threadable member.

10. The jewelry system of claim 1, wherein the threadable member is a necklace.

11. The jewelry system of claim 1, wherein the threadable member is an earring.

12. A method for assembling a jewelry system, the method comprising:

providing a rod comprising a stopper at a first end thereof and an eyelet at a second and opposite end thereof;

providing a first segment having a shape of an essentially flat ring and comprising two coaxially positioned apertures;

providing a second segment comprising one or two coaxially positioned apertures, wherein the outer diameter of the second segment is sufficiently small to fit within the ring of the first segment;

positioning the second segment within the ring of the first segment;

while the second segment is positioned within the first segment, sliding the first and second segments over the rod from the end thereof comprising the eyelet until reaching the stopper, the stopper having a larger outer diameter larger than the inner diameter of the apertures; and threading through the eyelet a threadable member, thereby preventing the first and segment segments from leaving the rod.

13. The method of claim 12, wherein the outer diameter of the eyelet is sufficiently smaller than the inner diameter of the apertures of the first and second segments to enable the first and second segments to be slided over the rod in a friction free manner and to allow each of the first and second segments to independently rotate around the rod when the rod extends through the apertures.

14. The method of claim 12, wherein said second segment has a shape of a flat plate, a circular, a rectangular ring or a triangular ring.

15. The method of claim 12, further comprising providing a third segment having a shape of an essentially flat ring, wherein said third segment is sized and shaped to allow the first segment to be positioned within its ring, wherein said third segment comprises two coaxially positioned apertures being essentially parallel to the ring's plane; and positioning the first and second segments within the ring of the third segment and wherein simultaneously sliding the first and second segments over the rod comprises simultaneously sliding the first, second and third segments over the rod.

16. The method of claim 15, wherein when said first, second and third segments are threaded on the rod, the third segments is allowed to spin/rotate around the rod independently of said first and said second segment.

17. The method of claim 16, wherein coaligned surfaces of said first, second and/or third segments form a mandala.

18. The method of claim 16, wherein rotation of said first, second and/or third segment relative to one another changes the shape of the mandala.

19. The method of claim 12, wherein, the rod is configured to extend perpendicularly to the longitudinal axis of the threadable member, when the treadable member is threaded through the no more than one eyelet.

20. The method of claim 12, wherein when threaded through the no more than one eyelet both ends of the threadable member are located on a same side of the first and second segments.

* * * * *